US009922559B1

(12) United States Patent
Inoue

(10) Patent No.: US 9,922,559 B1
(45) Date of Patent: Mar. 20, 2018

(54) SYSTEMS AND METHODS FOR GREEN LIGHT NUDGE MONITORING AND ALERT

(71) Applicants: Denso International America, Inc., Southfield, MI (US); DENSO CORPORATION, Kariya-shi, Aichi-ken (JP)

(72) Inventor: Marcus S. Inoue, San Diego, CA (US)

(73) Assignees: DENSO International America, Inc., Southfield, MI (US); DENSO CORPORATION, Kariya, Aichi-pref. (JP)

( * ) Notice: Subject to any disclaimer, the term of this patent is extended or adjusted under 35 U.S.C. 154(b) by 0 days.

(21) Appl. No.: 15/353,518

(22) Filed: Nov. 16, 2016

(51) Int. Cl.
*G08G 1/0967* (2006.01)
*G08G 1/095* (2006.01)

(52) U.S. Cl.
CPC ..... *G08G 1/096783* (2013.01); *G08G 1/095* (2013.01)

(58) Field of Classification Search
CPC ... B60R 1/006; G08G 1/09623; G08G 1/0967
USPC ..... 340/425.5, 426.23
See application file for complete search history.

(56) References Cited

U.S. PATENT DOCUMENTS

2005/0140523 A1 6/2005 Publicover
2006/0173611 A1* 8/2006 Takagi ..... G01C 21/3407 701/538
2009/0224942 A1 9/2009 Goudy et al.
2010/0109908 A1 5/2010 Miura
2011/0037618 A1 2/2011 Ginsberg et al.
2011/0245993 A1 10/2011 Goto
2011/0260886 A1 10/2011 Nagura et al.
2013/0076538 A1 3/2013 Uno et al.
2013/0110315 A1 5/2013 Ogawa
2013/0110316 A1 5/2013 Ogawa
2013/0245945 A1 9/2013 Morita et al.
2013/0337855 A1* 12/2013 Alexander ..... H04W 28/044 455/501
2014/0191882 A1 7/2014 Varma
(Continued)

FOREIGN PATENT DOCUMENTS

EP 2538397 A1 12/2012
JP 2004171459 A 6/2004
(Continued)

*Primary Examiner* — Kevin Kim
(74) *Attorney, Agent, or Firm* — Harness, Dickey & Pierce, P.L.C.

(57) ABSTRACT

Systems and methods for a green light detection and alert system for a vehicle are provided and include a green light nudge system that determines when to alert a driver of a vehicle and a driver alert system that alerts the driver when prompted by the green light nudge system. The green light nudge system includes a traffic signal determination unit that determines when a traffic signal changes from red to green, a vehicle path determination unit that determines when a vehicle path is clear of obstacles, and a vehicle nudge unit that sends a signal to the driver alert system to notify the driver of the vehicle. The vehicle nudge unit only sends the signal to notify the driver when the traffic signal determination unit determines that the traffic signal is green and the vehicle path determination unit determines that the vehicle path is clear.

20 Claims, 6 Drawing Sheets

(56) References Cited

U.S. PATENT DOCUMENTS

| | | | | |
|---|---|---|---|---|
| 2014/0222280 | A1* | 8/2014 | Salomonsson | G08G 1/167 701/28 |
| 2014/0225752 | A1 | 8/2014 | Lee | |
| 2015/0070156 | A1* | 3/2015 | Milburn, Jr. | B60Q 9/008 340/435 |
| 2016/0086486 | A1 | 3/2016 | Maeda | |
| 2016/0314689 | A1* | 10/2016 | Priest, III | B60W 50/14 |
| 2017/0124868 | A1* | 5/2017 | Bhat | G08G 1/09623 |
| 2017/0200369 | A1* | 7/2017 | Miller | G08G 1/162 |

FOREIGN PATENT DOCUMENTS

| | | | |
|---|---|---|---|
| KR | 20090018192 | | 2/2009 |
| TW | 200921577 | A | 5/2009 |
| WO | WO-2011101954 | A1 | 8/2011 |

* cited by examiner

SYSTEMS AND METHODS FOR GREEN LIGHT NUDGE MONITORING AND ALERT

FIELD

The present disclosure relates to systems and methods for a green light nudge system in a vehicle and, more particularly, green light nudge systems that provide monitoring and that alert a driver to enter an intersection during a green light.

BACKGROUND

This section provides background information related to the present disclosure which is not necessarily prior art.

There are many temptations to distract a driver waiting for a red light to turn green. A driver may text messages, talk on the phone, look for things in the car, or even do grooming. As a result, the driver may not notice the light change to green and either delay moving forward or miss the green light entirely. Consequently, traffic congestion worsens, drivers become frustrated, and carbon emissions increase.

The existing art deals with this problem by informing a driver of how long a traffic light signal will last, and alerts a driver of a signal change. At a traffic intersection, dedicated short range communications (DSRC) and non-DSRC based applications can be used to do this. For example, DSRC vehicle to infrastructure (V2I) applications receive Signal Phase and Timing (SPaT) messages from roadside equipment and inform the driver of how many seconds remain before the signal phase changes. Other DSRC-based systems inform the driver of this information through a display or as an alert. Non-DSRC based applications include Audi's® Online Traffic Recognition System, Connected Signals'® smart phone application Enlighten, and Honda's® Driving Support System, which uses infrared beacons. Some problems, however, remain with the existing systems. For example, the existing systems use countdown technology and drivers are alerted more often than necessary. As a result, a driver may elect to block out or turn off the alert system all together.

The present teachings improve on the existing systems by advantageously providing systems and methods to alert an inattentive driver to enter an intersection during a green light.

SUMMARY

This section provides a general summary of the disclosure, and is not a comprehensive disclosure of its full scope or all of its features.

A green light detection and alert system for a vehicle is provided and includes a green light nudge system for determining when to alert a driver of a vehicle and a driver alert system communicating with the green light nudge system and alerting the driver of the vehicle when prompted by the green light nudge system. The green light nudge system includes a traffic signal determination unit that determines when a traffic signal changes from red to green, a vehicle path determination unit that determines when a vehicle path is clear of obstacles, and a vehicle nudge unit communicating with the driver alert system to send a signal to the driver alert system to notify the driver of the vehicle. The vehicle nudge unit only sends the signal to notify the driver when the traffic signal determination unit determines that the traffic signal is green and the vehicle path determination unit determines that the vehicle path is clear.

A method for detecting a green light and alerting or nudging a driver of a subject vehicle is also provided. The method includes determining, with a green light nudge system, whether a traffic signal is green. The method also includes determining, with the green light nudge system, whether a vehicle path is clear. The method also includes activating, with a driver alert system, one or more of an audio notification, a visual notification, and a tactile notification to alert the driver of the subject vehicle in response to the green light nudge system determining that the traffic signal is green and the vehicle path is clear.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

The present teachings advantageously provide systems and methods to alert or nudge an inattentive driver to enter an intersection after a traffic signal has turned green. A driver may be nudged if his or her vehicle has not moved, the vehicle path is clear, and adequate time remains to exit the intersection before the next signal change. The nudge can come in the form of an alert rendered through a driver vehicle interface (DVI). Drivers will not be nudged, however, when the system determines it is hazardous to enter into the intersection. The present teachings are described as a DSRC based system, but could additionally or alternatively be extended to non-DSRC based applications.

Figure 1:
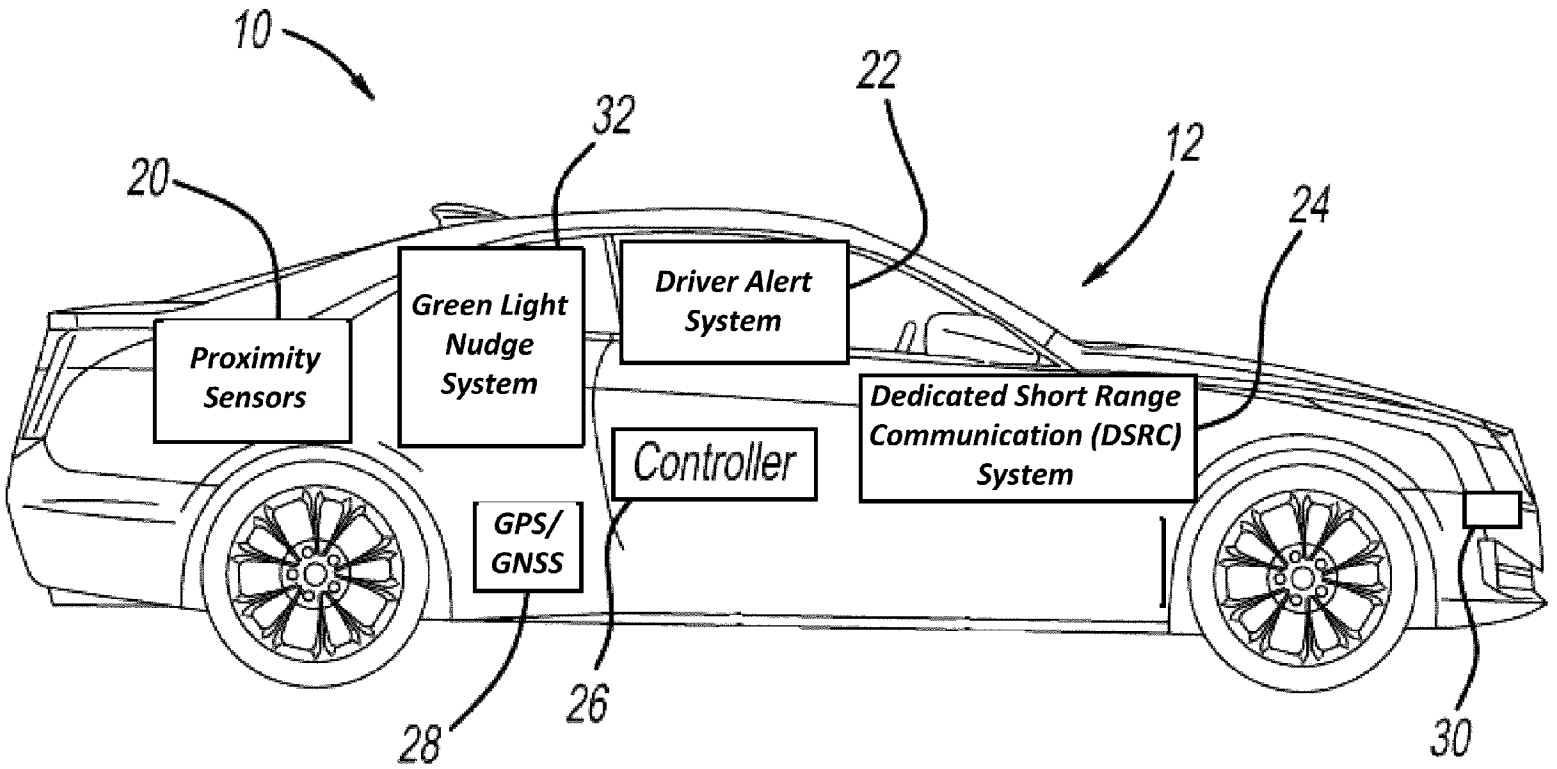
FIG. 1 illustrates a subject vehicle including a green light nudge system according to the present teachings for informing a driver of the subject vehicle that a traffic light has turned green.

With reference to FIG. 1, a vehicle 10 including a green light detection and alert system 12 according to the present teachings is illustrated. Although the vehicle 10 is illustrated as an automobile in FIG. 1, the present teachings apply to any other suitable vehicle, such as a sport utility vehicle (SUV), a mass transit vehicle (such as a bus), or a military vehicle, as examples. The system 12 is configured to inform a driver of the vehicle 10 (often referred to as the subject vehicle) that a traffic light has changed from a red signal to a green signal. The system 12 may generally include one or more proximity sensors 20, a driver alert system 22, a dedicated short range communication (DSRC) system 24, a controller 26, a global positioning system (GPS) or global navigation satellite system (GNSS) 28, one or more cameras 30, and a green light nudge system 32. The controller 26 can be any suitable controller for monitoring and/or controlling one or more of the proximity sensors 20, the driver alert system 22, the DSRC system 24, the GPS/GNSS 28, one or more of the cameras 30, the green light nudge system 32 and/or the additional vehicle systems, sensors, and functions. In this application, including the definitions below, the terms "controller" and "system" may refer to, be part of, or include processor hardware (shared, dedicated, or group) that executes code and memory hardware (shared, dedicated, or group) that stores code executed by the processor hardware. The code is configured to provide the features of the controller and systems described herein.

The proximity sensors 20 include one or more sensors configured to identify and/or detect the presence of objects, such as pedestrians, cyclists, or other vehicles, in one or more areas around the subject vehicle 10. The proximity sensors 20 can include any suitable sensors, such as any suitable radar, laser, camera, ultrasonic, or other suitable sensors for detecting objects in an area around the subject vehicle 10. The proximity sensors 20 can be mounted at any suitable position on the subject vehicle 10, such as in the front of the subject vehicle 10, rear of the subject vehicle 10, near the front corners of the subject vehicle 10, near the back corners of the subject vehicle 10, or along the sides of the subject vehicle 10.

The one or more cameras 30 include one or more cameras configured to identify and/or detect the presence of objects, such as pedestrians, cyclists, or other vehicles, in one or more areas around the subject vehicle 10. The cameras 30 may also be used to determine the state of the traffic light (i.e., red, green, or yellow). The cameras 30 can include any suitable camera for detecting objects in an area around the subject vehicle 10. The cameras 30 can be mounted at any suitable position on the subject vehicle 10, such as in the front of the subject vehicle 10, rear of the subject vehicle 10, near the front corners of the subject vehicle 10, near the back corners of the subject vehicle 10, or along the sides of the subject vehicle 10.

With reference to FIGS. 2-5, and as discussed in further detail below, the system 12 is configured to nudge or otherwise alert the driver of the subject vehicle 10 based on monitored or received traffic signal information, surrounding object information, traffic information, and/or road information.

Figure 2:
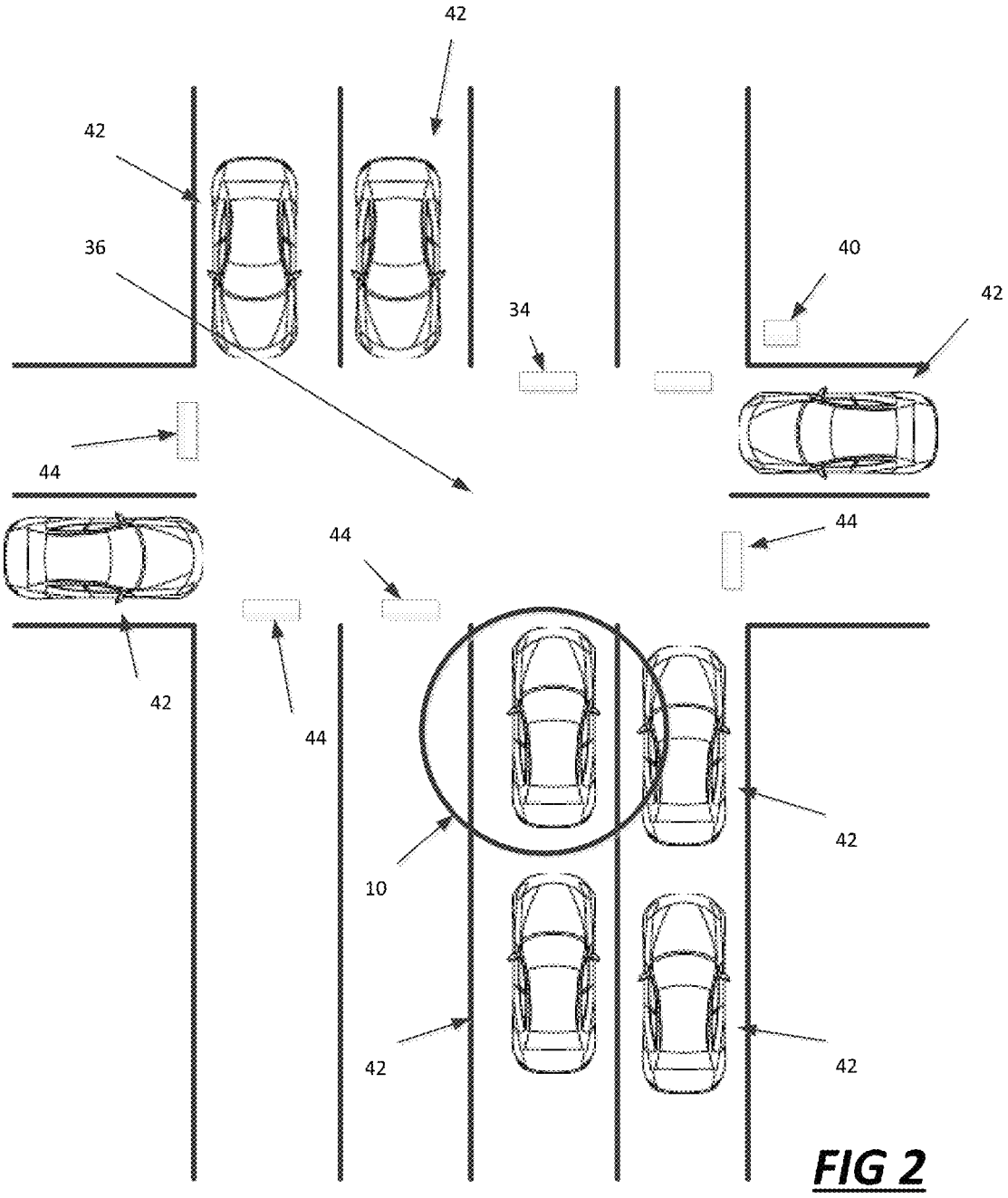
FIG. 2 illustrates the subject vehicle at an intersection having DSRC enabled traffic signals.

For example, with reference to FIG. 2, the subject vehicle 10, including the system 12, could be stopped at a traffic signal 34 in an intersection 36. The intersection 36 could include a DSRC radio 40 for communicating map data including the layout of the intersection and signal phase and timing (SPaT) data including traffic signal information. Various other vehicles 42 may also be stopped at other traffic signals 44 at the intersection 36.

The system 12 of the subject vehicle 10 can determine that the traffic signal 34 has changed from red to green, can determine that the intersection 36 is clear, can determine that there is adequate time to exit the intersection, and can nudge or otherwise alert the driver of the subject vehicle 10 to proceed through the intersection 36. Existing systems use countdown technology and, consequently, drivers are alerted more often than necessary. As a result, a driver may elect to block out or turn off the system all together. In the system 12 of the present teachings, however, a driver may only be nudged if his or her vehicle has not moved, the vehicle path is clear, and adequate time remains to exit the intersection before the next signal change. The nudge can come in the form of an alert rendered through a driver vehicle interface (DVI) or the driver alert system 22. The alert may include a visual alert, an audible alert, a tactile alert (also referred to as a haptic alert), or other suitable alert to prompt the driver. Drivers will not be nudged when the system 12 determines that it is hazardous to enter into the intersection. Thus, drivers are less likely to block out or turn off the system 12.

With reference to FIGS. 1 and 2, the green light nudge system 32 of the subject vehicle 10 can utilize the DSRC system 24 to communicate with the DSRC radio 40 of the intersection 36 to determine when the traffic signal 34 changes from red to green. For example, the DSRC system 24 of the subject vehicle 10 may receive signals from the DSRC radio 40 of the intersection 36 indicating map data, or a layout of the intersection, and SPaT data, or signal phase and timing information, for each traffic signal 34, 44. The DSRC system 24 of the subject vehicle 10 can receive signals from the DSRC radio 40 of the intersection 36 indicating that the traffic light 34 has changed from red to green, or the DSRC system 24 of the subject vehicle 10 can receive signals from the DSRC radio 40 of the intersection 36 providing a countdown timer until the traffic light changes from red to green.

In additional examples, the DSRC system 24 of the subject vehicle 10 may communicate with DSRC systems of the other vehicles 42 to determine the location of the other vehicles 42, or the DSRC system 24 of the subject vehicle 10 may communicate with DSRC systems found on pedestrians and cyclists in DSRC enabled phones. Vehicles, pedestrians, and cyclists could provide their dimensions, positions, predicted path, and acceleration through their DSRC systems.

The green light nudge system 32 of the subject vehicle 10 can use the GPS/GNSS 28 to determine time and position data of the subject vehicle 10. The GPS/GNSS 28 may also provide data describing the movement and acceleration of the subject vehicle 10. Thus, using the GPS/GNSS 28, the green light nudge system 32 can determine whether the subject vehicle 10 is stopped at a green light or whether it has begun to cross into the intersection 36.

Furthermore, the green light nudge system 32 of the subject vehicle 10 can communicate with the controller 26 through a controller area network (CAN) bus 48 (shown in FIG. 4) to determine an angle of the steering wheel, whether the left or right turn signal has been activated, a position of the accelerator pedal, or whether there is a malfunction of the subject vehicle 10, such as whether the check engine light has been illuminated and for what reason. The controller 26 also communicates with the one or more proximity sensors 20 and one or more cameras 30 to determine the placement or location of obstacles around the perimeter of the subject vehicle 10.

Figure 3A:
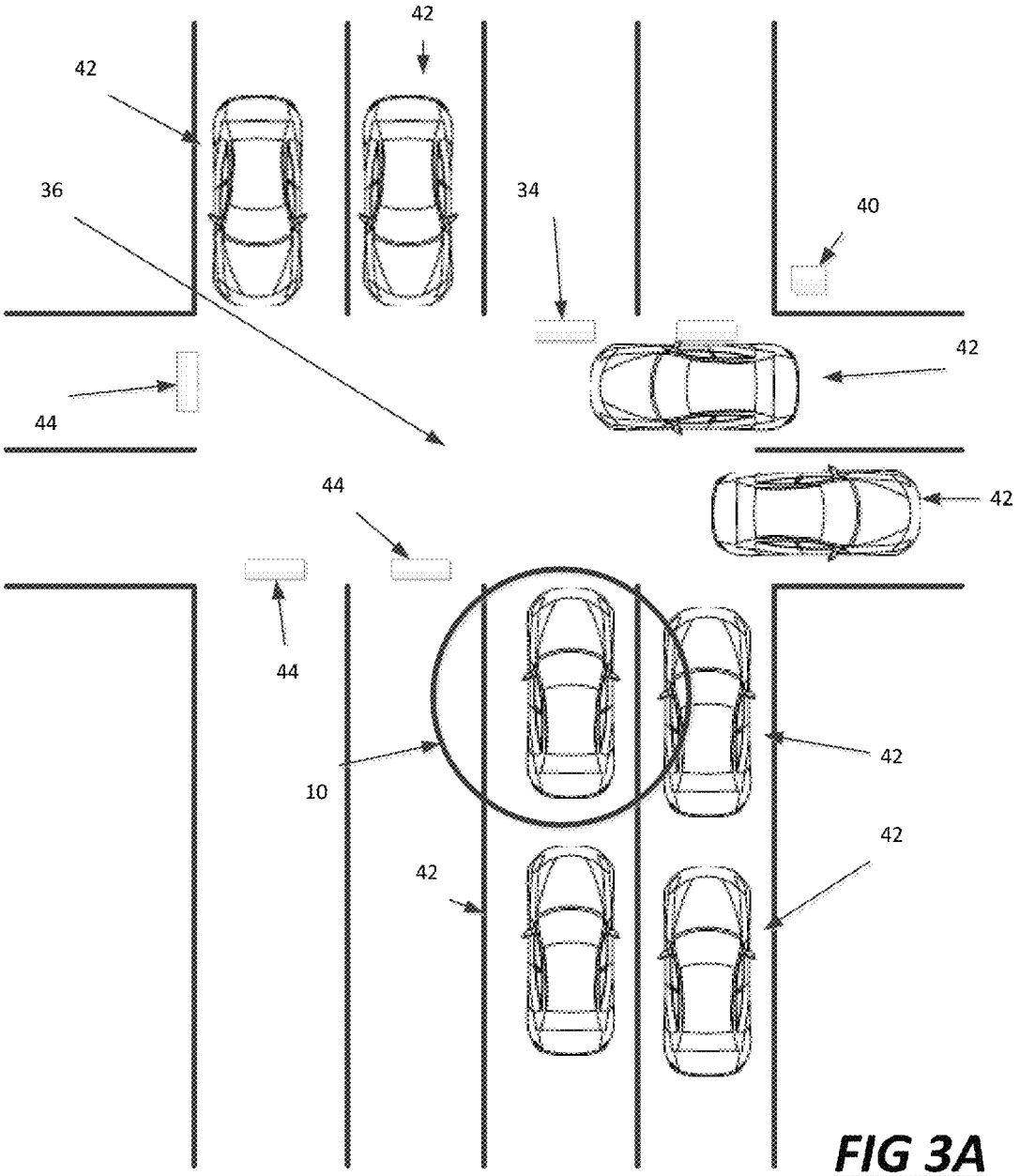
FIG. 3A illustrates the subject vehicle in an intersection where traffic has not cleared the intersection after the subject vehicle's traffic light changes to green.
Figure 3B:
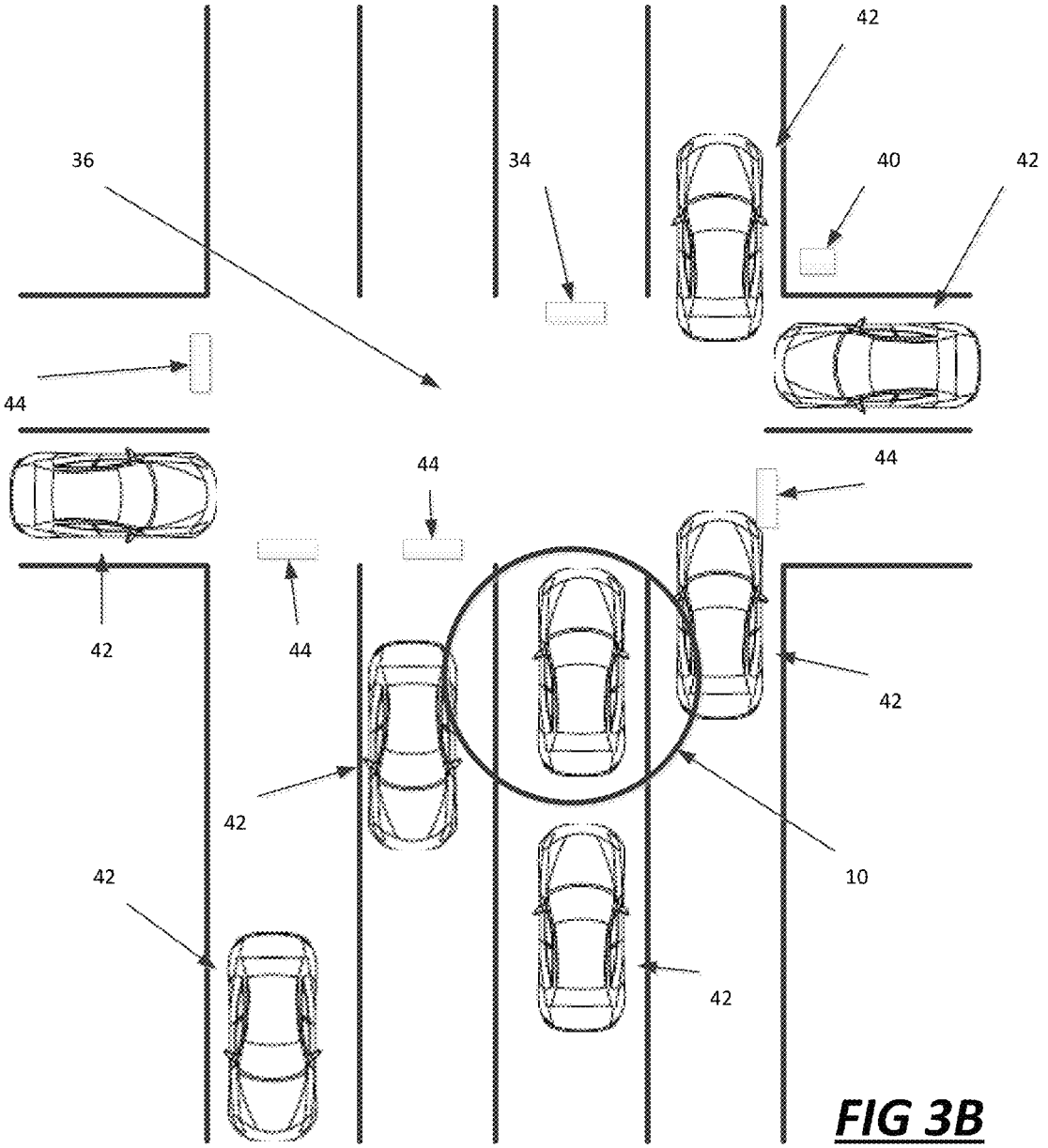
FIG. 3B illustrates the subject vehicle in an intersection where traffic has cleared the intersection after the subject vehicle's traffic light changes to green.

With additional reference to FIGS. 3A and 3B, when the system 12 determines that the subject vehicle 10 is at a DSRC enabled intersection 36, the system 12 waits for the traffic signal to turn from red to green. The DSRC system 24 of the subject vehicle 10 communicates with the DSRC radio 40 of the intersection 36 to determine traffic signal and intersection information, such as the layout of the intersection and the traffic signal timing. The DSRC system 24 of the subject vehicle 10 further determines when the traffic signal 34 changes from red to green.

Once the system 12 determines that the traffic signal 34 has changed from red to green, the system 12 determines whether it is safe to proceed into the intersection 36. The system 12 will not alert the driver of the subject vehicle 10 if there are obstacles, such as other vehicles 42 in the intersection 36 (as shown in FIG. 3A) or if there is another vehicle 42 between the subject vehicle 10 and the intersection 36, such as if the subject vehicle 10 is second or third in line at a traffic light. The system 12 communicates with the one or more proximity sensors 20 and one or more cameras 30 to determine whether the intersection 36 is clear of traffic. Only when the intersection 36 is clear of traffic and there are no vehicles between the subject vehicle 10 and the intersection 36, as shown in FIG. 3B, will the system 12 nudge the driver of the subject vehicle 10.

Figure 4:
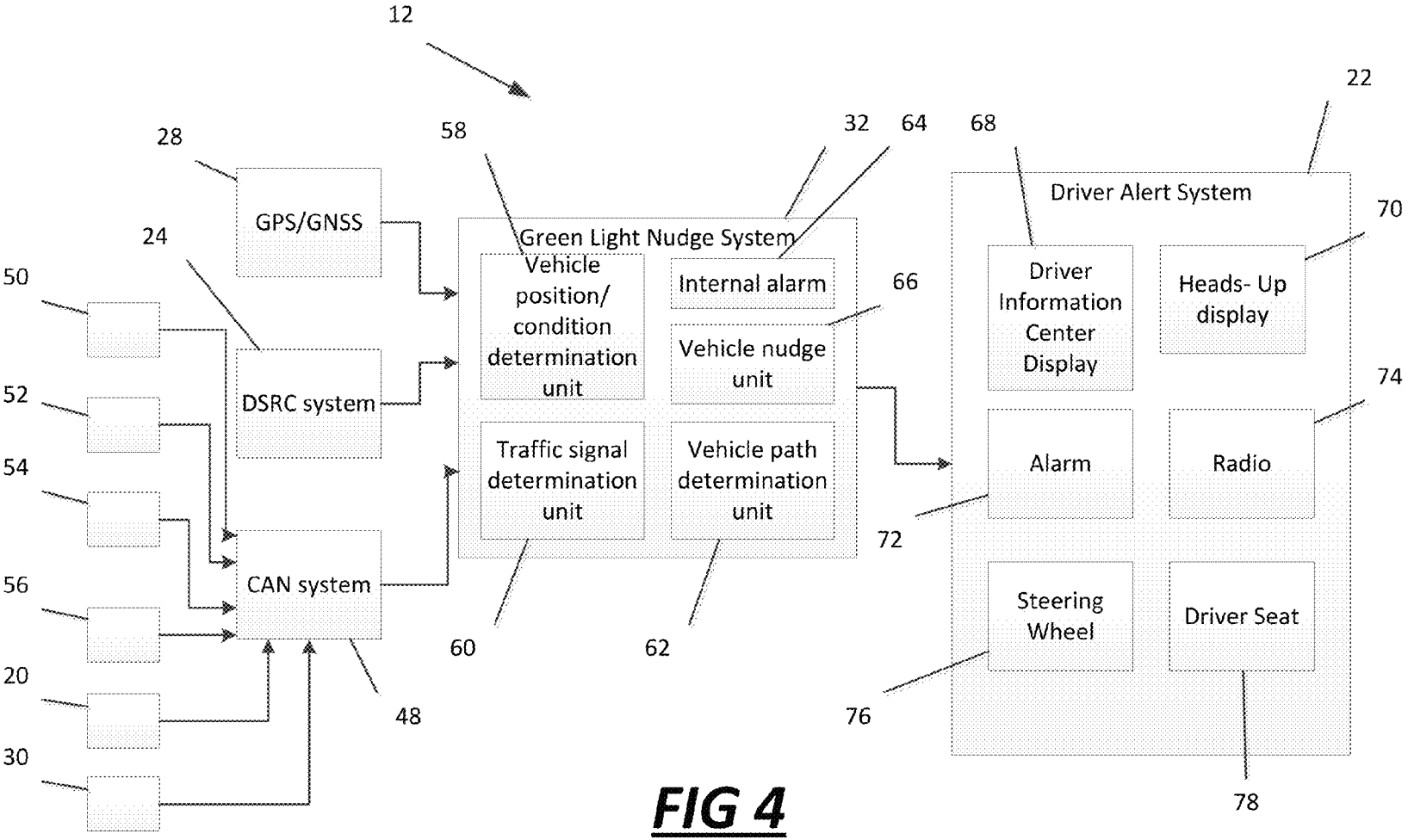
FIG. 4 illustrates a block diagram of a system according to the present teachings for detecting a green light and alerting or nudging an inattentive driver to enter a traffic intersection.

With reference to FIG. 4, a block diagram of the green light detection and alert system 12 according to the present teachings for detecting a green light and alerting or nudging an inattentive driver to enter a traffic intersection 36 is shown. The system 12 includes the green light nudge system 32, which communicates with and receives data from the GPS/GNSS 28, the DSRC system 24, and the control area network (CAN) bus 48. The GPS/GNSS 28 provides time and position data along with movement and acceleration data of the subject vehicle 10. The DSRC system 24 performs vehicle to vehicle (V2V), vehicle to infrastructure (V2I), and vehicle to any other DSRC radio communication to determine the location of other objects, vehicles, and/or people in relation to the subject vehicle 10. Also, the DSRC system 24 communicates with the DSRC radio 40 in the intersection 36 to determine traffic signal data, such as the timing of the traffic signal 34, the current state of the traffic signal 34, and map data, such as the layout of the intersection 36.

The CAN bus 48 communicates with various sensors and vehicle systems and passes the information to the green light nudge system 32. For example, the CAN bus 48 communicates with the one or more proximity sensors 20 which identify and/or detect the presence of objects, such as other vehicles 42, in one or more areas around the subject vehicle 10. The CAN bus 48 also communicates with the one or more cameras 30, which may determine the placement or location of obstacles around the perimeter of the subject vehicle 10. In addition, the CAN bus 48 communicates with a steering wheel position sensor 50, left and right turn signal sensors 52, an acceleration pedal position sensor 54, and various sensors 56 identifying mechanical problems with the subject vehicle 10. The steering wheel position sensor 50 provides steering wheel position data, the left and right turn signal sensors 52 provide turn signal activation and/or illumination data, the acceleration pedal position sensor provides the position of the acceleration pedal, and the sensors 56 identify mechanical issues with the subject vehicle 10, such as whether a check engine light is illuminated and, if so, for what reason.

Once data is received from the GPS/GNSS 28, the DSRC system 24, and the CAN bus 48, the green light nudge system 32 performs various calculations and functions to determine whether and when to nudge a driver of the subject vehicle 10. The green light nudge system 32 includes a vehicle position/condition determination unit 58 which uses data communicated by the GPS/GNSS 28 and CAN bus 48 to determine the position of the subject vehicle 10 and whether the subject vehicle 10 is experiencing any malfunctions. Specifically, the vehicle position/condition determination unit 58 uses data from the GPS/GNSS 28 to determine the location of the subject vehicle 10 and whether the subject vehicle is moving. The vehicle position/condition determination unit 58 also uses data from the acceleration pedal position sensor 54 passed through the CAN bus 48 to determine whether the vehicle is accelerating and uses data from the sensors 56 that identify mechanical issues passed through the CAN bus 48 to determine whether the check engine light is illuminated, and, if so, for what reason.

A traffic signal determination unit 60 uses data communicated by the DSRC system 24 to determine information about the traffic signal 34. Specifically, the DSRC system 24 communicates data that allows the traffic signal determination unit 60 to determine the current state of the traffic signal 34 and when the traffic signal 34 will change from red to green.

A vehicle path determination unit 62 uses data communicated from the GPS/GNSS 28, the DSRC system 24, and the CAN bus 48 to determine the path of the subject vehicle 10 and whether there are any vehicles or objects within the path. Specifically, the vehicle path determination unit 62 receives data from the DSRC system 24 detailing the layout of the intersection and receives data from the GPS/GNSS 28 that allows the vehicle path determination unit 62 to determine the position of the subject vehicle 10 within the layout of the intersection. The vehicle path determination unit 62 also receives data from the steering wheel position sensor 50 and left and right turn signal sensors 52 which allows the vehicle path determination unit 62 to determine whether the vehicle path is straight ahead of the subject vehicle 10 or to the right or left of the subject vehicle 10. Lastly, the vehicle path determination unit 62 receives data from the one or more proximity sensors 20 and/or the one or more cameras 30 to determine the location of other vehicles 42 around the subject vehicle 10.

An internal alarm 64 may be set by the green light nudge system 32 when the green light nudge system 32 determines that the vehicle is stopped at a green light and the vehicle path is clear. The internal alarm 64 provides sufficient time from the signal change for the driver of the subject vehicle 10 to proceed into the intersection 36. For example only, the internal alarm 64 may be set within a range of 3 to 10 seconds, and more preferably within a range of 4 to 7 seconds. The internal alarm 64 may trigger when the preset time expires to indicate that the subject vehicle 10 has been stopped at the traffic signal 34 for the preset amount of time.

A vehicle nudge unit 66 may determine the method and duration of the alert or nudge on the driver of the subject vehicle 10. The notification may be in the form of visual notification, audio notification, tactile notification, a combination thereof, or other suitable notification. The driver of the subject vehicle 10 may have the option to select which type of notification. This information would be received by the vehicle nudge unit 66 though the CAN bus 48. Further, based on the number of times in the drive cycle that the driver has been nudged, the vehicle nudge unit 66 may select different types of notification. Further, based on the number of times for the intersection 36 that the driver has been nudged, the vehicle nudge unit 66 may select a different method of notification or may escalate the notification (i.e., make it brighter, louder, or more intense, etc.).

Examples of an audio notification may include an audible alarm or spoken message. Thus, the green light nudge system 32 may send messages to the radio or speaker to project the audio notification. Examples of a visual notification may be a light or message that flashes on a heads-up display or on a driver interface center (DIC). Another visual notification may be an indicator on a console of the subject vehicle 10. Thus, the green light nudge system 32 may communicate with the DIC, heads-up display controller, or console to activate the visual notification. Lastly, examples of a tactile notification may be vibration of the steering wheel or driver seat. Thus, the green light nudge system 32 may communicate with the steering wheel control system or the driver seat control system to activate the tactile notification.

The green light nudge system 32 uses the data determined by the vehicle position/condition determination unit 58, the traffic signal determination unit 60, the vehicle path determination unit 62, the internal alarm 64, and the vehicle nudge unit 66 to determine whether to alert or nudge the driver of the subject vehicle 10, and if so, when and how to alert the driver of the subject vehicle 10. At the time determined to be proper to nudge the driver, the green light nudge system 32 communicates with the driver alert system 12 to indicate the time and type of notification. As previously stated, the green light nudge system 32 may communicate with the driver alert system 22 to prompt the driver alert system 22 to activate an audio alert, a visual alert, or a tactile alert by communicating with a driver information center display or 68, a heads-up display 70, an alarm or verbal message through the speaker 72 or radio 74, the steering wheel controller 76, or the driver seat controller 78.

Figure 5:
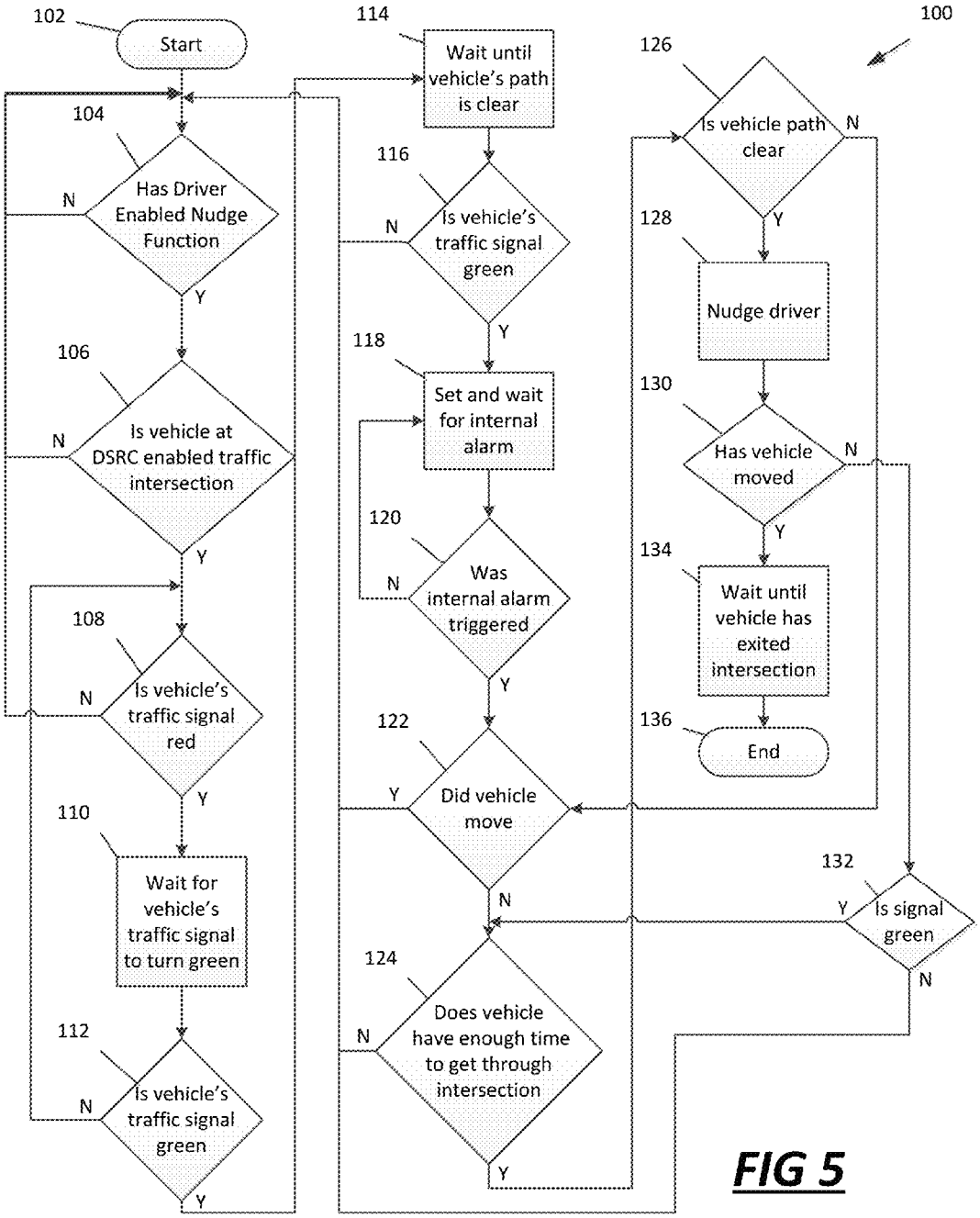
FIG. 5 illustrates a flow diagram for a method according to the present teachings for detecting a green light and alerting or nudging an inattentive driver to enter a traffic intersection.

With reference to FIG. 5, a flowchart for a method 100 is shown. The method 100 is configured to detect a green light on a traffic signal 34 and alert or nudge an inattentive driver to enter a traffic intersection 36. The method 100 can be performed by the system 12, the controller 26, the green light nudge system 32, a combination thereof, or any other suitable control or processing device. The method 100 starts at 102.

At 104, the green light nudge system 32 receives data from the CAN bus 48 and determines whether the driver has enabled the nudge function. If the driver has enabled the nudge function, the method moves to 106. If the driver has not enabled the nudge function, the method returns to 102.

At 106, the green light nudge system 32 receives data from the DSRC system 24 to determine whether the subject vehicle 10 is at a DSRC enabled traffic intersection. As previously discussed, the DSRC system 24 communicates with the DSRC radio 40 of the intersection 36. If the DSRC system 24 is able to communicate with the DSRC radio 40, then the green light nudge system 32 is able to determine that the subject vehicle 10 is at a DSRC enabled intersection 36, and the method moves to 108. If the DSRC system 24 is unable to communicate with the DSRC radio 40 of the intersection 36, then the intersection 36 is not DSRC enabled, and the method returns to 102.

At 108, the green light nudge system 32 receives data from the DSRC system 24, and the traffic signal determination unit 60 determines whether the traffic signal 34 at the intersection 36 is red. As previously described, the DSRC system 24 communicates with the DSRC radio 40 to gain map data and traffic signal data (SPaT data). The DSRC radio 40 transmits data such as the current state of the traffic signal 34 and a countdown timer until the traffic signal turns green. Thus, the traffic signal determination unit 60 may determine whether the current state of the traffic signal is red. If the traffic signal is red, the method 100 moves to 110, and if the traffic signal is green or yellow (a color other than red), the method returns to 102.

At 110, the green light nudge system 32 continues to receive data from the DSRC system 24 indicating the state of the traffic signal and waits for the traffic signal to turn green. The DSRC system 24 may receive a countdown timer from the DSRC radio 40 to enable the green light nudge system 32 to predict the traffic signal change, or the DSRC system 24 may constantly ping the DSRC radio 40 to determine the current state of the traffic signal. At 112, the green light nudge system 32 continues to monitor whether the traffic signal has turned green. If the signal is green, the method 100 moves to 114. If the signal is not green, the method 100 returns to 108.

At 114, the green light nudge system 32 receives data from the GPS/GNSS 28, the DSRC system 24, and the CAN bus 48 such that the vehicle path determination unit 62 can determine the path of the subject vehicle 10 and whether the path is clear. As previously stated, the DSRC radio 40 sends data to the DSRC system 24 detailing the layout of the intersection, and the GPS/GNSS 28 provides the position of the subject vehicle 10 such that the vehicle path determination unit 62 may determine the position of the subject vehicle 10 within the layout of the intersection. The vehicle path determination unit 62 also receives data from the steering wheel position sensor 50 and left and right turn signal sensors 52, which allows the vehicle path determination unit 62 to determine whether the vehicle path is straight ahead of the subject vehicle 10 or to the right or left of the subject vehicle 10. Lastly, the vehicle path determination unit 62 receives data from the one or more proximity sensors 20 and/or the one or more cameras 30 to determine the location of other vehicles 42 around the subject vehicle 10. The vehicle path determination unit 62 may use the data from the one or more proximity sensors 20 and/or the one or more cameras 30 to determine whether there are other vehicles 42 within the intersection (i.e. the vehicle path).

The green light nudge system 32 will not command an alert if there are obstacles, such as other vehicles 42 in the intersection 36 (as shown in FIG. 3A), if there is another vehicle 42 between the subject vehicle 10 and the intersection 36, such as if the subject vehicle 10 is second or third in line at a traffic light, or if there is a vehicle malfunction, such as a misfire, or other engine problem. Once the intersection is clear of traffic (as shown in FIG. 3B), the method 100 moves to 116.

At 116, the green light nudge system 32 determines whether the traffic signal 34 is still green. The green light nudge system 32 performs the same determinations as stated in 108 and 112, to make this determination. If the traffic signal is green, the method continues to 118. If the traffic signal has changed to something other than green, the method returns to 102.

At 118, the green light nudge system 32 sets the internal alarm 64. As previously stated, the internal alarm 64 is set to provide sufficient time from the signal change for the driver of the subject vehicle 10 to proceed into the intersection 36. For example only, the internal alarm 64 may be set within a range of 3 to 10 seconds, and more preferably within a range of 4 to 7 seconds. At 120, the green light nudge system 32 communicates with the internal alarm 64 to determine whether the alarm has triggered. The internal alarm 64 may trigger when the preset time expires to indicate that the subject vehicle 10 has been stopped at the traffic signal 34 for the preset amount of time. If the internal alarm 64 has triggered, the method 100 moves to 122. If the internal alarm 64 has not triggered, the method 100 returns to 118 and the green light nudge system 32 continues to wait for the internal alarm to trigger.

At 122, the green light nudge system 32 receives data from the GPS/GNSS 28 and CAN bus 48 such that the vehicle position/condition determination unit 58 may determine whether the subject vehicle 10 has moved. As previously stated, the green light nudge system 32 receives time/position data and movement and/or acceleration data from the GPS/GNSS 28 and receives acceleration pedal position data from the acceleration pedal position sensor 54 across the CAN bus 48. From the acceleration data, the vehicle position/condition determination unit 58 can determine if and how much the subject vehicle 10 has moved. If the subject vehicle 10 has moved, the method 100 returns to 102. If the subject vehicle 10 has not moved, the method 100 continues to 124.

At 124, the green light nudge system 32 receives data from the DSRC system 24 such that the vehicle position/condition determination unit 58 can determine whether the subject vehicle 10 has enough time to get through the intersection. The vehicle position/condition determination unit 58 and the vehicle path determination unit 62 determine the position of the vehicle at 106, 114, and 122. The DSRC system 24 provides map data and SPaT data from the DSRC radio 40 at the intersection 36. Thus, the vehicle position/condition determination unit 58 may determine the amount of time necessary to cross through the intersection and compare this time with the amount of time left on the green light timer from the DSRC radio 40. If the vehicle position/condition determination unit 58 of the green light nudge system 32 determines that the subject vehicle 10 has enough time to get through the intersection 36, the method 100 moves to 126. If there is not enough time for the subject vehicle 10 to get through the intersection 36, the method returns to 102.

At 126, the green light nudge system 32 determines whether the subject vehicle's 10 path is clear. The green light nudge system 32 follows the same process as in 114 for making the determination. If the path of the subject vehicle 10 is clear, the method 100 moves to 128. If the path of the subject vehicle 10 is not clear, the method 100 returns to 122.

At 128, the vehicle nudge unit 66 of the green light nudge system 32 sends a command to the driver alert system 22 to nudge the driver of the subject vehicle 10. As previously stated, the vehicle nudge unit 66 determines the method and duration of the alert or nudge on the driver of the subject vehicle 10. The notification may be in the form of visual notification, audio notification, tactile notification, or a combination thereof. If the driver of the subject vehicle 10 has the option to select which type of notification, the information is received by the vehicle nudge unit 66 though the CAN bus 48. Based on the number of times in the drive cycle that the driver has been nudged, the vehicle nudge unit 66 may select different types of notification, and based on the number of times for the intersection 36 that the driver has been nudged, the vehicle nudge unit 66 may select a different method of notification or may escalate the notification (i.e., make it brighter, louder, or more intense). If the nudge is an audio notification, the green light nudge system 32 may communicate with the alarm 72 or radio 74 in the driver alert system 22 to project the audio notification. If the nudge is a visual notification, the green light nudge system 32 may communicate with the DIC 68 or heads-up display 70 in the driver alert system 22 to activate the visual notification. If the nudge is a tactile notification, the green light nudge system 32 may communicate with the steering wheel control system 76 or the driver seat control system 78 in the driver alert system 22 to activate the tactile notification.

At 130, the green light nudge system 32 determines whether the subject vehicle 10 has moved. The same processes as in 122 may be used to determine whether the subject vehicle 10 has moved at 130. If the subject vehicle has not moved, the green light nudge system 32 determines whether the traffic signal 34 is green at 132. If so, the method returns to 124. If the traffic signal 34 is a color other than green (i.e., red or yellow), the method returns to 102.

If the subject vehicle has moved at 130, the method 100 waits until the vehicle has exited the intersection at 134. The green light nudge system 32 determines whether the subject vehicle 10 has exited the intersection 36 based on data from the GPS/GNSS 28 and/or the CAN bus 48 and the DSRC system 24. As previously stated, the GPS/GNSS 28 provides time/position and acceleration data for the subject vehicle 10. The DSRC system 24 provides map data of the intersection 36 from the DSRC radio 40. The CAN bus 48 passes through information from the acceleration pedal position sensor 54. Thus, the position and acceleration data allow the green light nudge system 32 to determine the speed and position of the subject vehicle 10 through the intersection 36, and the layout of the intersection 36 may be combined with the speed and position of the subject vehicle 10 to determine when the subject vehicle has exited the intersection 36. The method 100 ends at 136.

In this way, the present teachings advantageously provide systems and methods to alert or nudge an inattentive driver to enter an intersection after a traffic signal has turned green without relying solely on countdown technology and without alerting drivers more often than necessary, which could result in the driver blocking out the notifications or turning off the system all together.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A green light detection and alert system for a vehicle comprising:

a green light nudge system for determining when to alert a driver of a vehicle; and a driver alert system communicating with the green light nudge system and alerting the driver of the vehicle when prompted by the green light nudge system, wherein the green light nudge system includes:

a traffic signal determination unit that determines when a traffic signal changes from red to green;

a vehicle path determination unit that determines when a vehicle path is clear of obstacles;

a vehicle nudge unit communicating with the driver alert system to send a signal to the driver alert system to notify the driver of the vehicle; and a vehicle position/condition determination unit that determines a location of the vehicle and whether the vehicle is experiencing any mechanical malfunctions, wherein the vehicle nudge unit only sends the signal to notify the driver when the traffic signal determination unit determines that the traffic signal is green and the vehicle path determination unit determines that the vehicle path is clear, and wherein the green light nudge system does not notify the driver if the vehicle is experiencing any mechanical malfunctions.

2. The system of claim 1, wherein the green light nudge system further includes an internal alarm that is set and triggers after a predetermined amount of time, wherein the green light nudge system does not notify the driver until the internal alarm triggers.

3. The system of claim 2, wherein the internal alarm is set within a range of three to ten seconds.

4. The system of claim 1, further comprising a global positioning system or global navigation satellite system that communicates with the green light nudge system to provide vehicle position and movement or acceleration data.

5. The system of claim 1, further comprising a dedicated short range communication system that communicates with the green light nudge system to provide map data or traffic signal phase and timing data.

6. The system of claim 5, wherein the dedicated short range communication system communicates with other vehicles to provide position data of the other vehicles relative to the vehicle.

7. The system of claim 1, further comprising a control area network that communicates with the green light nudge system to provide a steering wheel angle from a steering wheel position sensor, left or right turn signal activation from left and right turn signal sensors, acceleration pedal position from an acceleration pedal position sensor, obstacle data from proximity sensors, and vehicle malfunction data from various other sensors.

8. The system of claim 1 wherein the driver alert system communicates with one or more of a driver information center, a heads-up display, an alarm, a radio, a steering wheel controller, and a driver seat controller to provide one or more of an audio alert, a visual alert, and a tactile alert.

9. The system of claim 1, wherein the green light nudge system receives information from one or more proximity sensors or one or more cameras through a control area network to determine whether the vehicle path is clear, and when another vehicle is within the vehicle path, the green light nudge system refrains from sending the signal to the driver alert system to alert the driver of the vehicle.

10. A method for detecting a green light and alerting or nudging a driver of a subject vehicle, the method comprising:

determining, with a green light nudge system, whether a traffic signal is green;

determining, with the green light nudge system, whether a vehicle path is clear;

determining, with the green light nudge system, a location of the subject vehicle and whether the subject vehicle is experiencing any mechanical malfunctions; and activating, with a driver alert system, one or more of an audio notification, a visual notification, and a tactile notification to alert the driver of the subject vehicle in response to the green light nudge system determining that the traffic signal is green and the vehicle path is clear, wherein the driver is not notified if the vehicle is experiencing any mechanical malfunctions.

11. The method of claim 10, further comprising determining, with a vehicle position/condition determine unit, a location of other vehicles in relation to the subject vehicle, wherein the green light nudge system determines whether the vehicle path is clear based on the location of the other vehicles in relate to the subject vehicle.

12. The method of claim 10, further comprising setting an internal alarm and waiting for the internal alarm to trigger before activating one or more of the audio notification, the visual notification, and the tactile notification to alert the driver of the subject vehicle.

13. The method of claim 12, wherein the internal alarm is set within a range of three to ten seconds.

14. The method of claim 10, further comprising determining whether the traffic signal is green from a dedicated short range communication radio disposed at an intersection.

15. The method of claim 14, further comprising determining whether the vehicle path is clear from map data received from the dedicated short range communication radio and one or more proximity sensors or one or more cameras disposed on the subject vehicle.

16. The method of claim 10, further comprising determining whether the subject vehicle is at a dedicated short range communication enabled intersection.

17. The method of claim 16, further comprising attempting to communicate with a dedicated short range communication radio at the intersection to determine whether the subject vehicle is at a dedicated short range communication enabled intersection.

18. The method of claim 10, further comprising determining whether the subject vehicle moved after determining whether the traffic signal is green and whether the vehicle path is clear.

19. The method of claim 18, further comprising analyzing at least one of time and position signals from a global positioning system or global navigation satellite system to determine acceleration and acceleration pedal position signals from an acceleration pedal position sensor to determine whether the subject vehicle moved.

20. A green light detection and alert system for a vehicle comprising:

a green light nudge system for determining when to alert a driver of a vehicle;

a driver alert system communicating with the green light nudge system and alerting the driver of the vehicle when prompted by the green light nudge system; and a control area network that communicates with the green light nudge system to provide a steering wheel angle from a steering wheel position sensor, left or right turn signal activation from left and right turn signal sensors, acceleration pedal position from an acceleration pedal position sensor, obstacle data from proximity sensors, and vehicle malfunction data from various other sensors, wherein the green light nudge system includes:

a traffic signal determination unit that determines when a traffic signal changes from red to green;

a vehicle path determination unit that determines when a vehicle path is clear of obstacles; and a vehicle nudge unit communicating with the driver alert system to send a signal to the driver alert system to notify the driver of the vehicle, wherein the vehicle nudge unit only sends the signal to notify the driver when the traffic signal determination unit determines that the traffic signal is green and the vehicle path determination unit determines that the vehicle path is clear.

* * * * *